United States Patent [19]

Tempke

[11] Patent Number: 4,960,208

[45] Date of Patent: Oct. 2, 1990

[54] EYEGLASS CASE KIT

[76] Inventor: Linda M. Tempke, P.O. Box 880, 1176 Gold Mt. Dr., Big Bear City, Calif. 92314

[21] Appl. No.: 440,335

[22] Filed: Nov. 22, 1989

[51] Int. Cl.[5] ..... A45C 11/04

[52] U.S. Cl. ..... 206/581; 206/6; 206/38; 383/99; 224/237

[58] Field of Search ..... 206/5, 5.1, 6, 38, 234, 206/581; 383/98, 99; 224/236, 237, 252

[56] References Cited

U.S. PATENT DOCUMENTS

| | | | |
|---|---|---|---|
| 763,519 | 6/1904 | Taylor et al. | 224/237 X |
| 1,995,664 | 3/1935 | Boyes | 206/5 |
| 2,479,472 | 8/1949 | Coplon | 206/5 X |
| 2,498,202 | 2/1950 | Dingman . | |
| 2,499,332 | 2/1950 | Schiff . | |
| 2,850,152 | 9/1958 | Marrufo | 206/38 |
| 3,124,240 | 3/1964 | Croan | 206/5 |
| 3,323,638 | 6/1967 | Dishart | 206/234 X |
| 3,647,056 | 3/1972 | Jacobson et al. | 206/38 |
| 4,287,985 | 9/1981 | Feniger | 206/5 |
| 4,418,733 | 12/1983 | Kallman . | |

FOREIGN PATENT DOCUMENTS

| | | | |
|---|---|---|---|
| 1353002 | 1/1964 | France | 206/5 |
| 2605504 | 4/1988 | France | 206/5 |

*Primary Examiner*—Paul T. Sewell
*Assistant Examiner*—Jacob K. Ackun, Jr.
*Attorney, Agent, or Firm*—Leon Gilden

[57] ABSTRACT

An eyeglass case kit is set forth including a case with an overlying flap wherein the flap includes a trapezoidal flap formed with an angulated terminal end securable to a forward face of the case to expose a resilient latch wherein the latch is selectively securable overlying a spray bottle containing a cleansing solution therein. The cleansing solution cooperates with a cleansing fabric cloth positioned in and formed integrally to a forward face of the case. An interior surface of the flap includes a transparent information pocket with a forward edge spaced from a side edge of the flap to contain an information slip within the information pocket and abuttable against an eyeglass pair positioned within the case. The case is securable to items, such as a belt worn by a user or selectively securable to a fabric surface, such as a dashboard and the like, by a hook and loop fastening surface formed to an exterior surface of a clip formed to an exterior surface of the case.

9 Claims, 1 Drawing Sheet

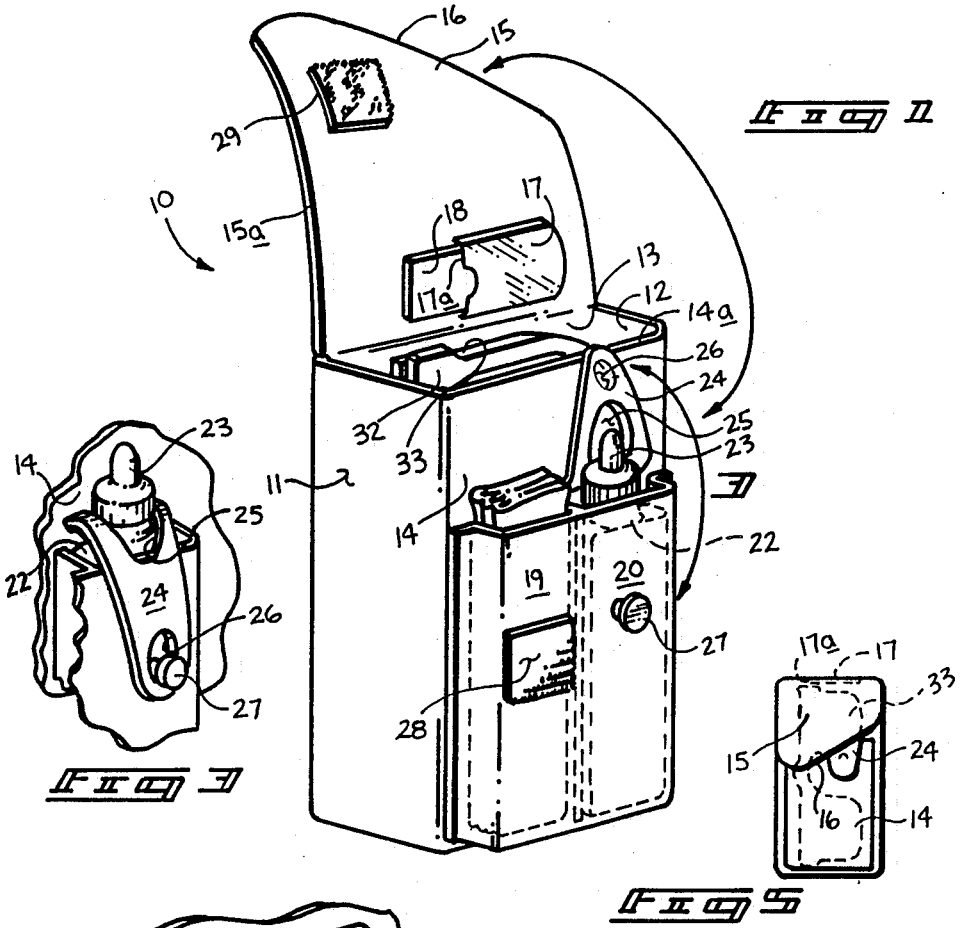
Fig 1
Fig 3
Fig 5
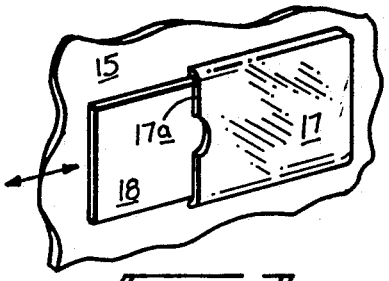
Fig 2
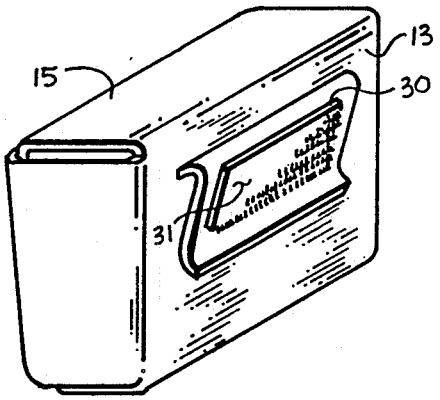
Fig 4

EYEGLASS CASE KIT

BACKGROUND OF THE INVENTION

1. Field of the Invention

The field of invention relates to eyeglass containers, and more particularly pertains to a new and improved eyeglass kit containing an assembly for the care and maintenance of eyeglasses contained therein.

2. Description of the Prior Art

The use of eyeglass cases of various types is known in the prior art. Heretofore the prior art has failed to provide an operative kit assembly enabling maintenance of an eyeglass assembly contained therein in an enhanced readily available format. An example of an eyeglass container as set forth by the prior art may be found in U.S. Pat. No. 2,499,332 to Schiff setting forth an eyeglass container securable within a conventional purse arrangement. The container is of interest relative to its securable association to an individual's garment.

U.S. Pat. No. 2,498,202 to Dingman sets forth a spectacle case wherein the case is formed with elastomeric sides to enable the container to be deformed for the acceptance of an eyeglass assembly therein.

U.S. Pat. No. 2,479,472 to Coplon sets forth an eyeglass assembly including a memorandum pad and writing instrument associated with the case, but fails to provide an assembly of eyeglass care items in a readily usable and accessible form as set forth by the instant invention.

U.S. Pat. No. 4,287,985 to Feniger sets forth an eyeglass case wherein the case is provided with flexible interior members to enable finger pressure to clean lenses of an associated eyeglass assembly without direct contact of the assembly by the fingers.

U.S. Pat. No. 4,418,733 to Kallman sets forth a multipurpose securement pouch wherein the pouch is of a complementary configuration to various objects and may be secured about the objects utilizing hook and loop fastener portions.

As such, it may be appreciated that there continues to be a need for a new and improved eyeglass case kit wherein the same addresses both the problems of ease of use and effectiveness in organization, and in this respect, the present invention substantially fulfills this need.

SUMMARY OF THE INVENTION

In view of the foregoing disadvantages inherent in the known types of eyeglass cases now present in the prior art, the present invention provides an eyeglass case kit wherein the same may be compactly stored during periods of non-use and may be further easily and effectively arranged for the cleansing and care of eyeglasses therewith. As such, the general purpose of the present invention, which will be described subsequently in greater detail, is to provide a new and improved eyeglass case kit which has all the advantages of the prior art eyeglass case organizations and none of the disadvantages.

To attain this, the present invention comprises an eyeglass case kit including a flexible case formed of a parallelepiped configuration with a trapezoidal flap secured to an upper edge of a rear wall of the case wherein an outer terminal edge of the flap is angulated relative to a forward wall of the case when secured to the forward wall to enable access to a fastening strap securing a cleansing solution bottle therewithin. An adjacent pocket formed relative to the cleansing container is provided with an overfolded array of fabric cloth for the cleansing of the eyeglass assembly contained within the case. The flap further contains an information pocket with a forward edge spaced from the lower edge of the cover flap an equal distance to that of an eyeglass frame edge of the eyeglass assembly, wherein the eyeglass frame edge secures an associated information card within the information pocket. A first hook and loop fastener formed on a forward pocket of the case is associatable with a second hook and loop fastener patch secured to an interior surface of the flap spaced above &he information pocket. A rigid "S" shaped clip is secured to a rear surface of the rear wall of the case and further includes a third hook and loop fastener patch for selective securement to a fabric surface. such as an automotive dashboard and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar a they do not depart from the spirit and scope of the present invention.

Further, the purpose of the foregoing abstract is to enable the U.S Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved eyeglass case kit which has all the advantages of the prior art and none of the disadvantages.

It is another object of the present invention to provide a new and improved eyeglass case kit which may be easily and efficiently manufactured and marketed.

It is a further object of the present invention to provide a new and improved eyeglass case kit which is of a durable and reliable construction.

An even further object of the present invention is to provide a new and improved eyeglass case kit which is susceptible of a low cost of manufacture with regard to both materials an labor, and which accordingly is then susceptible of low prices of sale to the consuming public, thereby making such eyeglass case kit economically available to the buying public.

Still yet another object of the present invention is to provide a new and improved eyeglass case kit which provides in the apparatuses and methods of the prior art some of the advantages thereof, while simultaneously overcoming some of the disadvantages normally associated therewith.

Still another object of the present invention is to provide a new and improved eyeglass case kit wherein the same provides for the securement of cleaning materials in association with the eyeglass assembly contained within the case and further provides for an information packet formed on an interior surface of the closure flap for securement of the eyeglass assembly within the case.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and object other than those set forth above will become apparent when consideration is given to the following detailed description thereof. Such description makes reference to the annexed drawings wherein:

FIG. 1 is an isometric illustration of the instant invention.

FIG. 2 is an isometric illustration of section 2 as set forth in FIG. 1.

FIG. 3 is an isometric illustration, somewhat expanded, of the resilient securement flap maintaining the cleansing spray bottle within its associated pocket.

FIG. 4 is a rear isometric illustration of the instant invention.

FIG. 5 is a frontal orthographic view taken in elevation of the instant invention.

DESCRIPTION OF THE PREFERRED EMBODIMENT

With reference now to the drawings, and in particular to FIGS. 1 to 5 thereof, a new and improved eyeglass case kit embodying the principles and concepts of the present invention and generally designated by the reference numeral 10 will be described.

More specifically, it will be noted that the eyeglass case kit 10 essentially comprises a case of a generally parallelepiped configuration including a right side wall 11 spaced from and parallel to a left side wall 12 with an adjoining rear wall 13 orthogonally oriented relative to the right and left side walls spaced rearwardly from a forward wall 14. A trapezoidal cover flap 15 is integrally and hingedly formed to an upper edge of the rear wall 13 and is formed of a generally trapezoidal configuration defined by a forward terminal angulated forward edge 16 at a generally acute angle relative to the upper edge of the rear wall 13. An interior surface of the cover flap 15 includes a transparent information pocket 17 including an information card 18 removably positionable within the pocket 17 to contain ownership information of the eyeglass case kit 10, as well as cleaning and maintenance of the eyeglass assembly 32 contained within the case. The information pocket 17 includes a forward edge **17*a* spaced a fixed distance from a right edge 15*a* of the cover flap 15. The eyeglass assembly 32 securable within the case includes an eyeglass frame edge 33 that is in abutment with the forward edge 17*a* of the pocket 17 to maintain the eyeglass assembly 32 in a predetermined orientation within the eyeglass case as well as maintaining the information card 18 within the pocket 17**.

The forward wall 14 includes a plurality of pockets fixedly mounted thereon with first information pocket 19 spaced adjacent to a second information pocket 20. The pockets 19 and 20 are aligned with one another and are in an underlying orientation relative to a upper edge **14*a* of the forward wall 14. The first pocket 19 includes a fabric cloth 21 of a generally usable material that may be washed or inserted within the first pocket, or else readily replaced by subsequent fabric cloth 21 for the cleansing of the lenses of the eyeglass assembly 32 by means of a cleansing solution contained within a spray bottle 22 contained within the second pocket 20. The spray bottle 22 is formed of a resilient squeeze container with the projection spray tip 23 secured thereon. The spray bottle 22 is contained within the second pocket 20 by use of a stretchable resilient securement flap 24 hingedly mounted to the forward wall 14 rearwardly and in alignment with a forward upper edge of the second pocket 20 such that the securement flap 24 may be stretched over the spray tip 23 for securement about a boss 27 formed with an enlarged head secured orthogonally and integrally to the forward wall of the second pocket 20. The securement flap 24 is formed with a first opening 25 to receive the spray tip 23 therethrough with a second opening 26 of an area substantially less than the first opening 25 to extend over the boss 27, as illustrated in FIG. 3**.

Formed adjacent the boss 27 is a first hook and loop fastener patch 28 cooperative with a second hook and loop fastener patch 29 formed on the interior surface of the cover flap 15 spaced above the information pocket 17. As illustrated in FIG. 5, the forward edge 16 of the cover flap 15 exposes the boss 27 and the forward end of the securement flap 24 to enable release of the securement flap 24 prior to opening of the cover flap 15 to enable an individual to withdraw the spray bottle 22 from within the second pocket 20 for replenishment thereof. The visibility of the securement flap 24 alerts a individual to the securement of the spray bottle within the second pocket 20. Further, the exterior positioning of the spray bottle 20 relative to the case enables an individual to discharge spray through the projection spray tip 23 without removing the spray bottle from the pocket 20.

The rear surface of the rear wall 13 includes a rigid "S" shaped clip 30 to enable securement of the case to many items, such as a belt and the like worn by an individual, or alternatively, a third hook and loop fastener patch 31 as secured to a rear surface of the "S" shaped 30 enables temporary securement of the case to a support surface, such as an automotive interior fabric surface to enable secure orientation of the case during transport thereof.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to on skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An eyeglass case kit comprising a case including a forward wall, a rear wall, a right side wall, and a left side wall, and a covering flap pivotally mounted to an upper edge of the rear wall and pivotal from a first extended open position to a second covering position overlying the forward wall including a hook and loop fastening patch mounted to an interior surface of the flap, and a plurality of pockets fixedly mounted to an exterior surface of the forward wall and of a length positioned below an upper edge of the forward wall, and including a further hook and loop fastening patch mounted on an exterior surface of one of said pockets to selectively engage said hook and loop fastening patch of the covering flap, wherein the plurality of pockets comprise two pockets with a first pocket, and a fabric cloth, and the fabric cloth selectively mounted within the first pocket, and a spray bottle, and the spray bottle selectively mounted within the second pocket, and the second pocket including an orthogonally outwardly extending securement boss wherein the securement boss includes an enlarged head, and the second pocket further includes a securement flap positioned rearwardly of the second pocket and engageable with the securement boss.

2. An eyeglass case kit as set forth in claim 1 wherein the securement flap is resilient and includes a first opening positioned to receive a projection spray tip of the spray bottle, and the securement flap further including a second opening for engagement with the securement boss.

3. An eyeglass case kit as set forth in claim 2 wherein the covering flap is of a trapezoidal configuration to expose the securement boss when the covering flap is in the second position.

4. An eyeglass case kit as set forth in claim 3 wherein the covering flap further includes a transparent information pocket secured to the interior surface of the covering flap, and the information positioned a fixed distance from a right edge of the covering flap wherein the right edge is aligned with the right side wall.

5. An eyeglass case kit as set forth in claim 4 wherein the case is formed of a flexible material and of a parallelepiped configuration.

6. An eyeglass case kit as set forth in claim 5 further including an eyeglass assembly mounted within the case, and the eyeglass assembly includes terminal eyeglass frame edge, and the eyeglass frame edge spaced a fixed distance, and wherein the information pocket is in engagement with the frame edge when the covering flap is in the second position.

7. An eyeglass case kit as set forth in claim 6 further including an information card selectively mounted within the information pocket.

8. An eyeglass case kit as set forth in claim 7 wherein a rigid "S" shaped clip includes an upper elongate edge fixedly mounted parallel to the covering flap onto a rear surface of the rear wall and wherein the rigid "S" shaped clip is mounted for receiving a garment portion of a user for transport of the eyeglass case kit.

9. An eyeglass case kit as set forth in claim 8 further including a hook and loop fastener strip secured to an external surface of the rigid "S" shaped clip wherein the hook and loop fastener strip is mounted for securement to a fabric support surface for securement of an eyeglass case kit.

* * * * *